United States Patent [19]

Genovese

[11] Patent Number: 4,706,964

[45] Date of Patent: Nov. 17, 1987

[54] FOOTBALL TRAINING APPARATUS

[76] Inventor: Louis M. Genovese, route de Biot, F.06560 Valbonne, France

[21] Appl. No.: 865,203

[22] PCT Filed: Aug. 26, 1985

[86] PCT No.: PCT/FR85/00228

§ 371 Date: Apr. 21, 1986

§ 102(e) Date: Apr. 21, 1986

[87] PCT Pub. No.: WO86/01419

PCT Pub. Date: Mar. 13, 1986

[30] Foreign Application Priority Data

Aug. 28, 1984 [FR] France ..... 84 13408

[51] Int. Cl.[4] ..... A63B 43/00

[52] U.S. Cl. ..... 273/413; 273/26 E; 273/55 R; 273/58 C; 273/411

[58] Field of Search ..... 273/411, 413, 58 C, 273/26 E, 55 R

[56] References Cited

U.S. PATENT DOCUMENTS

| | | | |
|---|---|---|---|
| 3,166,316 | 1/1965 | O'Leary | 273/26 |
| 4,125,230 | 11/1978 | Fischer | 273/184 B X |
| 4,296,925 | 10/1981 | Alston | 273/411 X |
| 4,462,599 | 7/1984 | Brown | 273/413 X |
| 4,576,379 | 3/1986 | Juhasz | 273/411 |

FOREIGN PATENT DOCUMENTS

| | | | |
|---|---|---|---|
| 8201769 | 11/1983 | Netherlands | 273/411 |
| 333591 | 8/1930 | United Kingdom . | |

*Primary Examiner*—William H. Grieb

*Attorney, Agent, or Firm*—Lerner, David, Littenberg, Krumholz & Mentlik

[57] ABSTRACT

A football (33) is attached to the end of a line (36) mounted in a winding/unwinding system (15) fixed to one end of an adjustable boom (9) supported by a post (8) integral with a mobile stand (1).

The football (33) is kept a certain distance below the boom (9) by means of a small ball and a retaining box (32) which is adjusted to compensate solely the weight of the football, so that the football can be freed at the slightest impact.

13 Claims, 9 Drawing Figures

FOOTBALL TRAINING APPARATUS

This invention relates to a training apparatus for players of football and games of heading, volleying and half-volleying, comprising a mobile boom adjustable in height, position and inclination, equipped with a device for retrieving the football which consists of a line and a winding/unwinding system. The training of footballers, players of games of heading, volleying and half-volleying presently requires a person to throw the football towards the player, retrieve it and then throw it again-which requires some skill and makes this kind of training rather tedious.

A training apparatus for the game of tennis is described in British Patent Specification No. 333 591. The device described in this British patent includes a boom and a ball attached to the end of an elastic line. In this device, the return of the ball is brought about thru the elasticity of the line and not by a winding/unwinding system for a non-elastic line. With a means of retrieval of this kind, a football, being much heavier than a tennis ball, would always be subjected to a restoring force which would change its trajectory considerably and would set up severe, undamped vibrations during the return to the initial position. This would set up heavy stresses in the boom which are likely to result in progressive deterioration of the boom.

A training device for the game of golf is known also, comprising a winding/unwinding system for a line, to one end of which a ball is attached, as set forth in U.S. Pat. No. 4,125,230. The electro-mechanical winding-/unwinding system returns the ball automatically to rest against a collar. With a means of this kind for retrieving and holding a football in position, the ball would not have sufficient freedom to react in the same way as a free ball when acted upon by the head or foot of the player, and this would completely upset the training of the players.

The object of the present invention is to eliminate the disadvantages presented by combining the two above-mentioned devices. The invention as characterized in the claims solves the problem of creating a training apparatus for footballers, players of games of heading, volleying and half-volleying, comprising a device for steadying and positioning the football, the vertical adjustment of which is made by means of a stayrod of adjustable length and a sliding sleeve mounted on the post and fixed by a locking screw, and a mechanical or electro-mechanical winding/unwinding system fixed to the boom by means of a tubular socket and a locking screw, the post carrying the boom being supported by a stand fitted with detachable casters having adjustable spacing, and with a control screw.

The boom is adjustable in height, position and inclination by means of a sleeve and a screw, a strap and a spindle, a tubular socket fitted at the end of a post supporting the boom and a locking screw, a stayrod of adjustable length and a sleeve sliding on the post which is fixed by means of a locking screw.

The football is retrieved by means of a line of suitable length and a mechanical or electro-mechanical winding/unwinding system, the football being attached to the line via a flexible collar which is provided with a threaded part and a tapped plugged fitted with a ring.

The device for steadying the football and positioning it vertically consists of a small sphere thru which the line for retrieving the football passes and which is fixed on the line at a particular distance from the football, and a box holding the small sphere, mounted at the end of a flexible guiding tube thru which the line passes, rendered free to rotate by means of ball bearings, a rigid tube and a spacer, relative to a tube locked by a screw at the end of the boom.

The box holding the small sphere consists of a cylindrical box with a splay at the entrance to it, with a tapped hole at the bottom that enables it to be connected to the flexible guiding tube, and of which the wall has openings in it into which the convex part of steel-wire springs projects, the upper end of which springs is held against the above-mentioned wall, on the outside, by an elastic ring whose position is adjustable, and the lower end resting against the edge of the splay situated at the entrance to the box.

According to a preferred embodiment of the invention, the winding/unwinding system consists of a very light, hollow reel mounted on ball bearings, driven in rotation for winding by means of an ordinary disk integral with the reel spindle, and a retractable disk with anti-friction fittings, integral with a follower mounted on a threaded spindle driven in rotation by an electric motor reduction gear which can be energized in a controlled way.

Energization of the electric motor reduction gear for driving the reel is controlled by two electric microswitches attached to the wall and outside of the retaining box and projecting inside the box thru openings, in order to come into contact with the ball for steadying and positioning, so as to control the de-energizing on completion of line-winding, and the delayed energizing after the football has moved away, respectively.

According to another mechanical embodiment of the invention, the winding/unwinding system consists of a very light, hollow reel mounted on ball bearings, driven in rotation for winding by means of crown wheels, one of which is integral with the reel and the other, retractable, one integral with a follower mounted on a threaded spindle driven in rotation by a spur gear train and, where applicable, by a sprocket, a transmission chain and another sprocket integral with a crank handle, mounted at the end of a tubular socket locked by a screw on an arm which is articulated with a sliding sleeve mounted on the post supporting the boom by means of a yoke and a spindle, or by the same gear train, a bevel gear, a fluted shaft with longitudinal clearance and by a bevel gear integral with a crank handle which is mounted on a plate integral with a sleeve sliding on the post supporting the boom.

The post supporting the boom is supported by a stand equipped with detachable casters, the spacing of which is adjustable by means of telescopic arms supporting two tubular sockets into which a steering control bar and the mast supporting the boom fit, respectively, locked in position by screws.

The advantages gained by this invention consist essentially in the height of the football being adjustable very precisely relative to the ground, according to the height of the player and the type of training, and in the football always being at a particular distance from the retaining box, which is adjusted in order to compensate exactly the weight of the football, so that the football can move away and release the line at the least impact—enabling a trajectory to be obtained which matches in every respect the trajectory which would be obtained with a football completely free.

Other characteristics and advantages will appear in the following description of an apparatus for training footballers, in its various embodiments, given as an example which is not limitary with regard to the appended drawings, in which.

Figure 1:
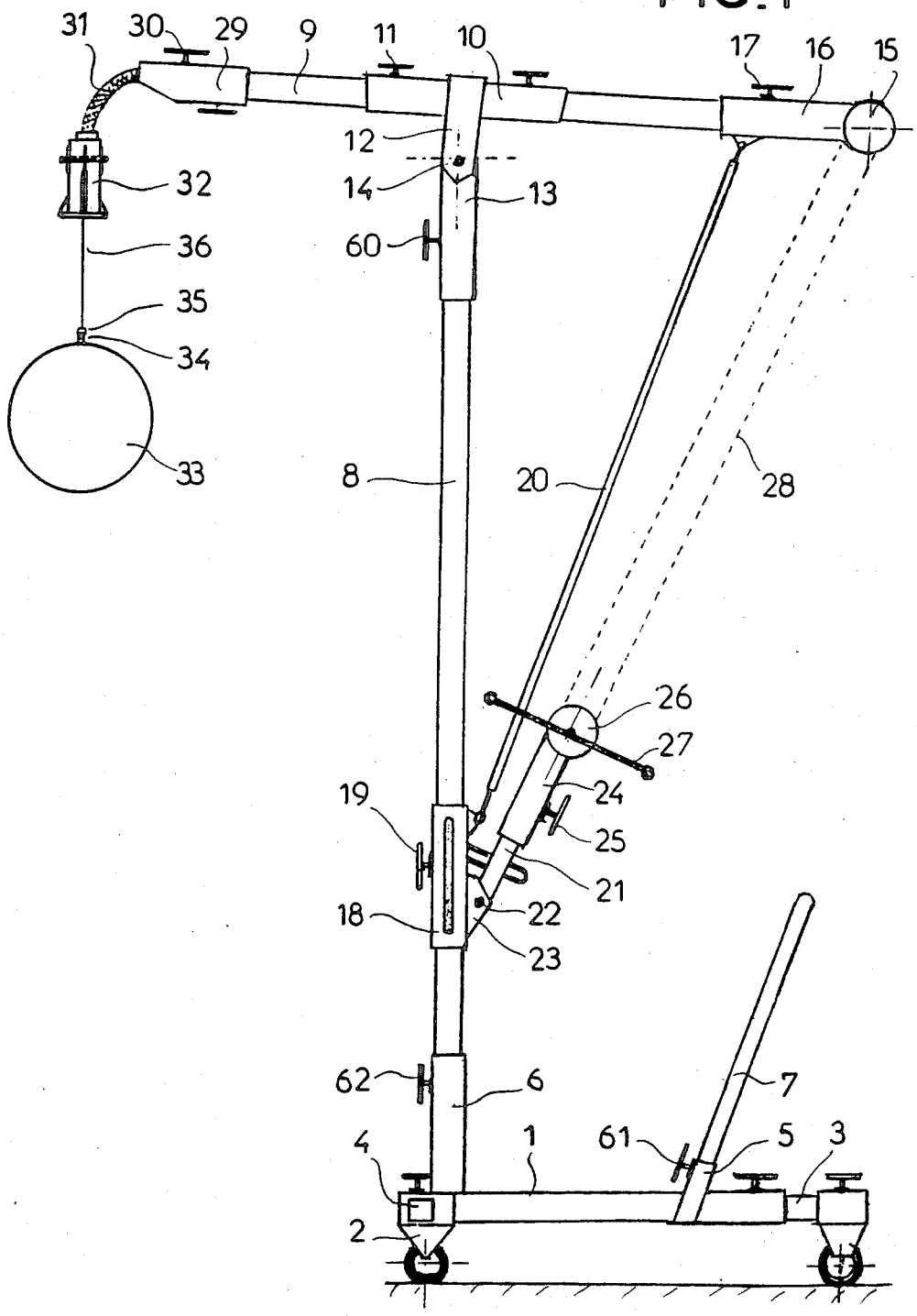
FIG. 1 shows a view in elevation of the apparatus equipped with a mechanical winding/unwinding system driven by sprockets and chains.

It will be seen in FIG. 1 that the apparatus consists mainly of a stand 1 equipped with detachable casters 2 provided with adjustable spacing by means of telescopic arms 3 and 4, supporting two tubular sockets 5 and 6 in which a steering control bar 7 and a post 8, respectively, are fitted; a boom which is adjustable laterally by means of a sleeve 10 and a screw 11, and in inclination by means of a strap 12 which is integral with the sleeve 10 and a spindle 14 arranged at the end of a tubular socket 13 attached to the upper end of the post 8 and fixed by the screw 60; a winding/unwinding mechanism 15 mounted at the end of a tube 16 fixed at the end of the boom 9 by a locking screw 17; a sliding sleeve 18 with locking screw 19, connected to the tube 16 supporting the winding/unwinding mechanism 15 by means of a stay-rod of adjustable length 20; an arm 21 which is articulated with the sliding sleeve 18 by means of a spindle 22 and a yoke 23 on which a tube 24 is fitted, fixed by the screw 25, at the end of which a sprocket 26 is mounted, fitted with a crank handle 27. which is used for remote operation of the winding/unwinding mechanism 15 via the chain 28; a tubular socket 29 fixed to the other end of the boom 9 by locking screws 30, supporting by means of a flexible tube 31 a box 32 for steadying and positioning the football 33 connected to the winding mechanism by a flexible threaded collar 34 a tapped plug fitted with a ring 35 and a line 36.

Figure 2:
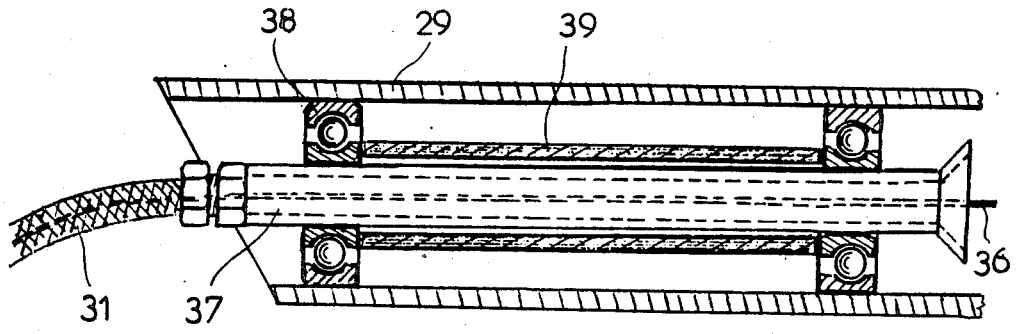
FIG. 2 shows a view in longitudinal section of the guidance device for the flexible guiding tube for the football retrieving-line.

It will be seen in FIG. 2 that the flexible tube 31 is made free to rotate relative to the tubular socket 29 by means of a rigid tube 37, ball bearings 38 and a spacer 39.

Figure 3:
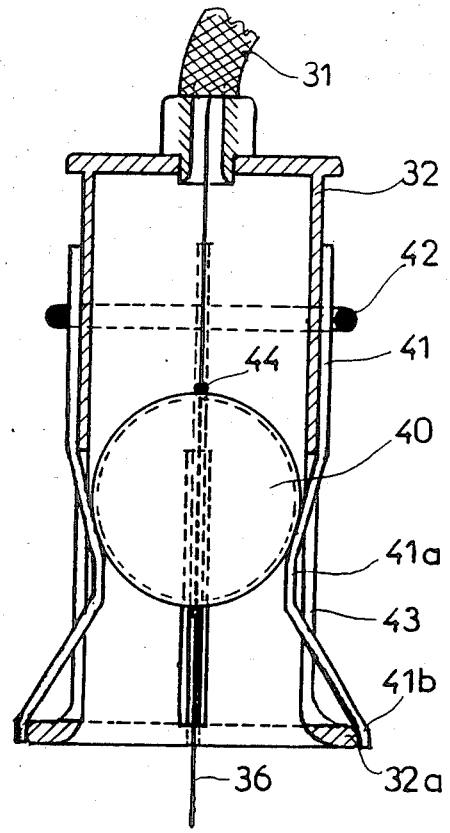
FIG. 3 shows a view in longitudinal section of the box holding the sphere for positioning and steadying the football.

It will be seen in FIG. 3 that the football 33 is positioned vertically and supported by means of a small sphere 40 held inside the box 32 by means of steel-wire springs 41, which are held against the outside of the wall of the box 32 by an elastic ring 42, the convex part 41*a* of which springs projects into the box 32 through the openings 43 and of which one of the ends 41*b* rests against a splay 32*a* situated at the entrance to the box 32. The sphere 40 is fixed on the line 36, which passes thru it, by means of knots or rings 44.

Figure 4:
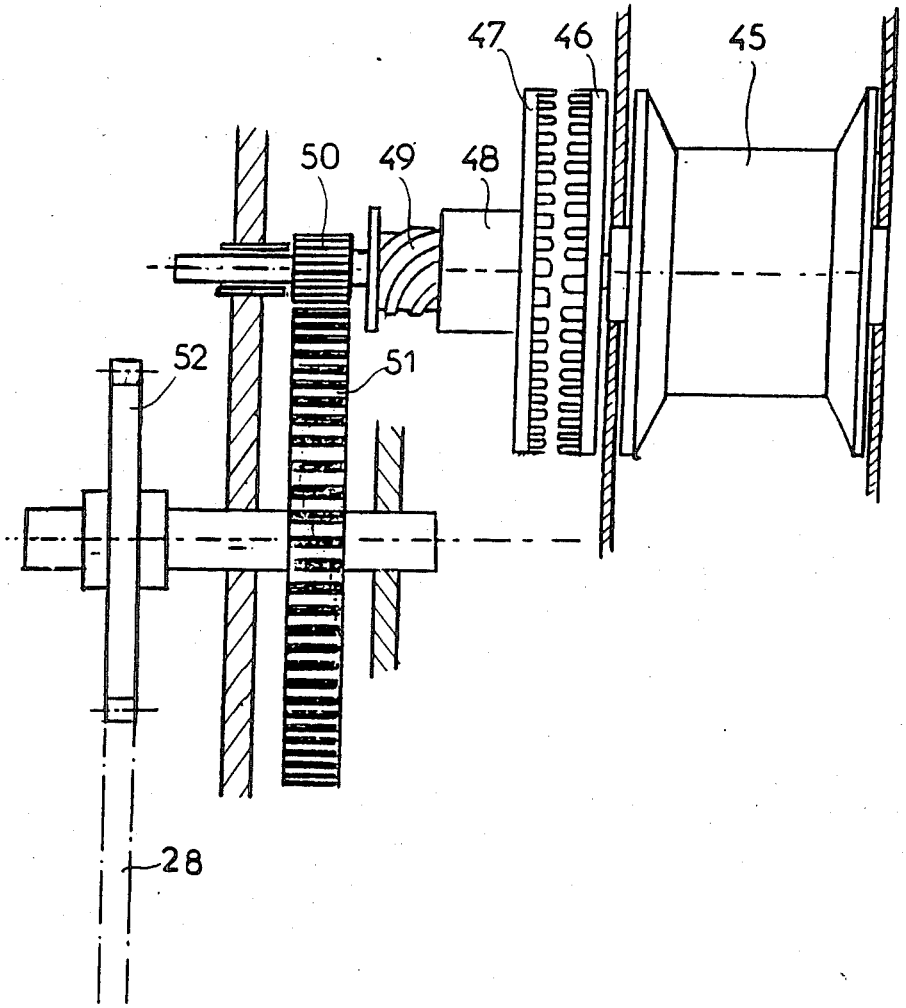
FIG. 4 shows a front view of the chain-driven mechanical winding/unwinding system.
Figure 8:
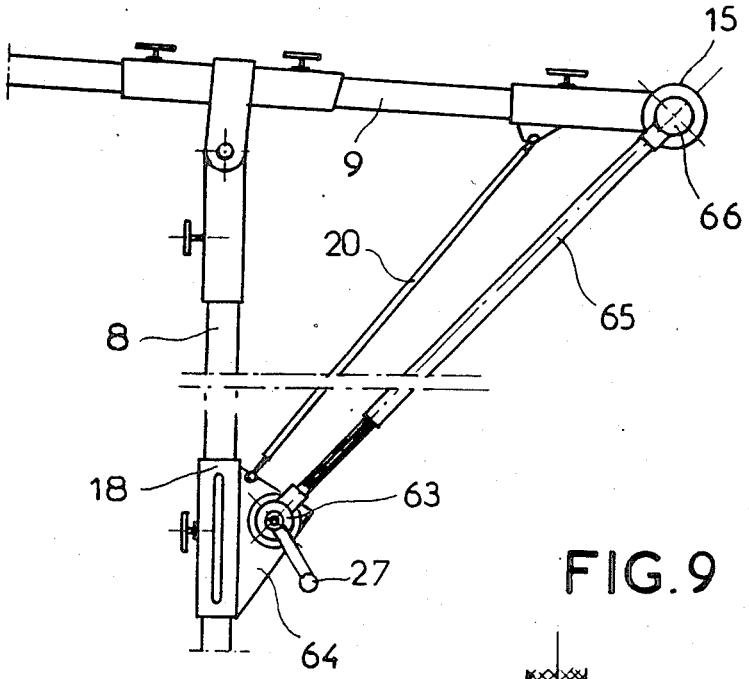
FIG. 8 shows the detail of the system for driving the mechanical winding/unwinding mechanism by means of a sliding fluted shaft and bevel gears.

It will be seen in FIG. 4 that the winding/unwinding mechanism 15 consists, in the mechanical embodiment, of a reel 45, crown wheels 46 and 47 of which one is integral with the reel spindle 45 and the other integral with a follower 48 mounted on a threaded spindle 49 driven in rotation by a train of spur gears 50 and 51, a sprocket 52 and a transmission chain 28 or, in a preferential embodiment shown in FIG. 8, by a first bevel gear 63 mounted on a plate 64 which is integral with the sliding sleeve 18, a transmission by sliding fluted shaft 65 and a second bevel gear 66 in direct engagement with the train of spur gears 50 and 51.

Figure 5:
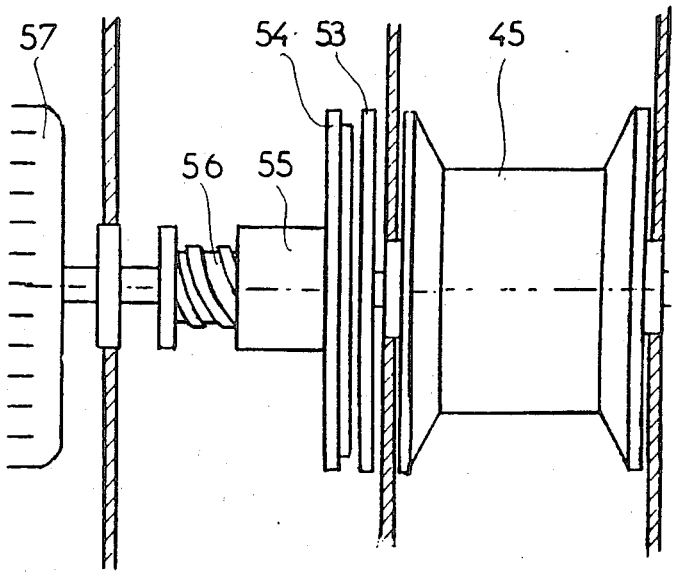
FIG. 5 shows a front view of the electro-mechanical winding/unwinding system.

It will be seen in FIG. 5 that the winding/unwinding system consists, in the electro-mechanical embodiment, of a reel 45 integral with the plain disk, 53 and a retractable disk 54 provided with anti-friction fittings, which is integral with a follower 55 mounted on a threaded spindle 56 driven in rotation by a motor reduction gear 57.

Figure 6:
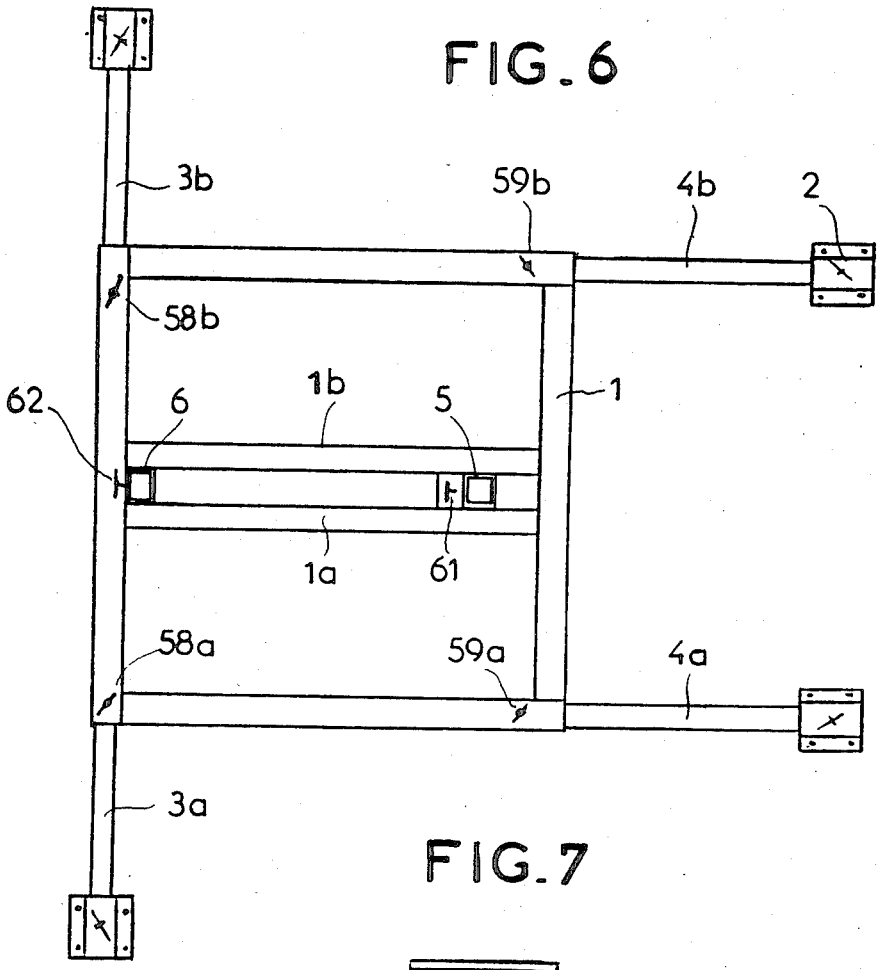
FIG. 6 shows a plan view of the stand for the boom.

It will be seen in FIG. 6 that the stand 1 comprises a tubular frame into the sides of which fit, telescopically, arms 3*a* and 3*b*, 4*a* and 4*b*, at the end of which detachable casters 2 are mounted. Telescopic arms 3*a* and 3*b* are locked in position by means of screws 58*a* and 58*b*, 59*a* and 59*b*. On the top of the stand, between two cross-members 1*a* and 1*b*, tubular sockets 5 and 6 are attached, into which the steering control bar 7 and the post supporting the boom 8, respectively, are fitted.

Figure 7:
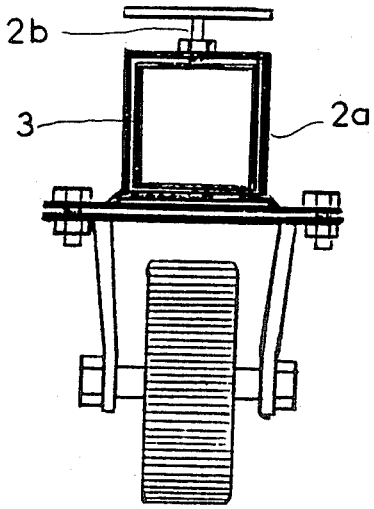
FIG. 7 shows a front view of a detachable caster.

It will be seen in FIG. 7 that the detachable casters 2 are attached to the telescopic arms by means of a sleeve 2*a* and a locking screw 2*b*.

Figure 9:
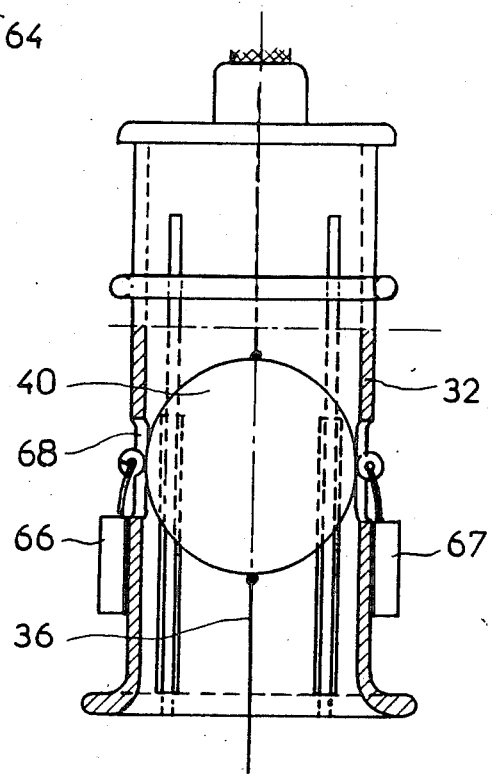
FIG. 9 shows a view in longitudinal section of the retaining box equipped with micro-switches for stopping and starting the motor reduction gear driving the electro-mechanical winding/unwinding mechanism.

It will be seen in FIG. 9 that the electric micro-switches 66 and 67 for cutting off the electricity supply to the motor reduction gear on completion of winding-in of the line 36 and for delayed re-energizing after the football has moved away, are attached to the outside wall of the retaining box 32 and come into contact with the sphere 40 through openings 68.

It can thus be seen by referring again to FIGS. 1, 2, 3 and 4 that the height above the ground of the football 33 can be adjusted very precisely, according to the height of the player and the type of training, by action upon the sliding sleeve 18 after slackening and then retightening the screw 19, since this screw enables the tilt of the boom 9 to be varied by means of the stay-rod 20.

The range of adjustment can be changed by moving the boom 9 longitudinally relative to the sleeve 10, after slackening and then retightening the screw 11 and/or changing the depth of penetration of the post 8 into the tubular socket 13, after slackening and then retightening the locking screw 60, and into the tubular socket 6, after slackening the retightening the screw 62.

It will be seen that the football 33 is always at a specific distance from the retaining box 32, on which the tension of the springs 41 is adjusted by action upon the elastic ring 42 in order to compensate exactly the weight of the football 33, so that the small sphere 40 can escape and free the line 36 at the slightest impact upon the football. It is easy to understand that, by causing the elastic ring 42 to roll along the springs 41, their effect upon the sphere 40 can be increased or decreased, as desired.

During winding-in, operation of the crank handle 27 will cause the crown wheel 47 to engage by inertia in the crown wheel 46 driving the reel 45, thru the sprocket 26, the chain 28, the sprocket 52, or thru the bevel gear 63 of the fluted shaft 64 and bevel gear 65, the train of spur gears 50 and 51 and the screw-threaded spindle 49. The line can then be wound in until the sphere 40 butts against the bottom of the retaining box 32, after the springs 44 which hold it captive have flattened, until there is another impact upon the football 33. Retraction of the crown wheel 47 will be obtained as soon as it is driven by the reel 45, or preferably by slight reversing of the crank handle 27.

In the electro-mechanical embodiment the micro-switch 66 for cutting off the power to the motor on completion of winding-in, and the micro-switch 67 for delayed re-energizing of the motor, being acted upon by the sphere 40, will have been de-energized during the entry of the sphere 40 into the box 32 at the end of winding-in and re-energized after a delay when the football is moving away, by the micro-switch 67, subject to the above-mentioned switches 66 and 67 having been selected, wired and incorporated in a suitable circuit in accordance with current practice of electrical control.

The apparatus according to the invention is intended principally for training footballers; however, with some modifications it could be used also for other sports in which a ball is used—basket-ball and volley-ball, for example.

What is claimed is:

1. A training apparatus for footballers and for players of games of hitting, volleying and half volleying, comprising:

(a) a stand;

(b) a boom support post extending upwardly from said stand;

(c) a boom;

(d) adjustable positioning means for mounting said boom to said support post so that said boom is adjustable in height, position and inclination, said adjustable positioning means including a sleeve slidably mounted on said boom support post, a locking screw engaged with said sleeve and said boom support post for fixing the position of said sleeve on said boom support post, a stay-rod extending from said sleeve to said boom and means for adjusting the length of said stay-rod;

(e) a ball;

(f) a line attached to said ball;

(g) winding/unwinding means for winding and unwinding said line; and (h) steadying means for steadying said ball at a predetermined vertical position with respect to said boom, whereby the vertical position of said ball with respect to said base may be adjusted by adjusting said adjustable positioning means.

2. A training apparatus as claimed in claim 1 further comprising a plurality of casters mounted to said base and defining spacings therebetween, and means for adjusting the positions of said casters with respect to said base so as to adjust said spacings.

3. A training apparatus as claimed in claim 2 wherein said winding/unwinding means includes a reel rotatably mounted to said boom and means for driving said reel so as to wind said line onto said reel.

4. A training apparatus as claimed in claim 3 further comprising a tube mounted to said boom and a tube locking screw engaged with said tube and said boom, said reel being attached to said boom by means of said tube.

5. A training apparatus as claimed in claim 1 further comprising a flexible collar having screw threads attached to said ball and a plug having screw threads, said plug being attached to said line, said plug being threadedly engaged with said collar so that said ball is attached to said line by said collar and said plug.

6. A training apparatus as claimed in claim 1 wherein said steadying means includes a sphere surrounding said line and attached to said line at a predetermined distance from said ball, a flexible guiding tube having two ends, means for connecting one end of said flexible guiding tube to said boom so that said flexible guiding tube is free to pivot with respect to said boom, and a box connected to the other end of said flexible guiding tube and supported by said flexible guiding tube, said line extending through said box and said flexible guiding tube, said sphere being received in said box when said ball is at said predetermined vertical position with respect to said boom.

7. A training apparatus as claimed in claim 6 wherein said box has a lower end and an upper end, said box having an entrance opening at said lower end, said upper end being connected to said flexible guiding tube, said steadying means further comprising spring means for releasably retaining said sphere within said box.

8. A training apparatus as claimed in claim 7 further comprising means for adjusting said spring means to thereby adjust the force required to release said sphere from said box.

9. A training apparatus as claimed in claim 7 wherein said winding/unwinding means includes a reel rotatably mounted to said boom, means for driving said reel so as to wind said line onto said reel and thereby pull said sphere into said box, and means for disengaging said reel from said drive means when said sphere is in said box, whereby said reel can rotate freely to unwind said line when said sphere is dislodged from said box by forces applied to said ball.

10. A training apparatus as claimed in claim 9 wherein said drive means includes a spindle rotatably mounted to said boom adjacent said reel, a clutch having a drive element and a driven element, said driven element of said clutch being connected to said reel, said drive element of said clutch being connected to said spindle, said clutch also including means for engaging said drive element of said clutch with said driven element of said clutch upon rotation of said spindle relative to said boom in a driving direction corresponding to winding of said line onto said reel and means for disengaging said drive element from said driven element upon rotation of said spindle relative to said boom in the opposite direction, said drive means further comprising means for rotating said spindle relative to said boom.

11. A training apparatus as claimed in claim 10 wherein said means for rotating said spindle includes a crank rotatably mounted to said stand and means for connecting said spindle to said crank for rotation therewith, so that said spindle may be rotated relative to said boom in either direction by turning said crank in either direction.

12. A training apparatus as claimed in claim 10 wherein said means for driving said spindle includes an electric motor, said spindle being connected to said motor.

13. A training apparatus as claimed in claim 12 further comprising means for detecting whether said sphere is in said box or outside of said box and controlling said electric motor so as to energize said motor after said sphere leaves said box to wind said line and pull said sphere back into said box and terminate said winding when said sphere is in said box.

* * * * *